US006793286B2

(12) United States Patent
Burgin

(10) Patent No.: US 6,793,286 B2
(45) Date of Patent: Sep. 21, 2004

(54) CHAIR ADJUSTMENT MECHANISM

(75) Inventor: Ralph C. Burgin, West Point, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/253,777

(22) Filed: Sep. 24, 2002

(65) Prior Publication Data

US 2003/0071506 A1 Apr. 17, 2003

Related U.S. Application Data

(60) Provisional application No. 60/324,295, filed on Sep. 25, 2001.

(51) Int. Cl.[7] ..... B60N 2/02

(52) U.S. Cl. ..... 297/353; 297/411.36

(58) Field of Search ..... 297/353, 411.36, 297/411.57; 248/118

(56) References Cited

U.S. PATENT DOCUMENTS 4,036,525 A * 7/1977 Howk ..... 297/353
4,451,084 A * 5/1984 Seeley ..... 297/353
4,466,665 A * 8/1984 Aronowitz et al. ..... 297/418
4,616,877 A * 10/1986 Slaats et al. ..... 297/353
4,639,039 A 1/1987 Donovan
4,749,230 A * 6/1988 Tornero ..... 297/353
4,930,840 A * 6/1990 Tornero ..... 297/353
5,405,189 A * 4/1995 Stumpf ..... 297/353
5,685,609 A * 11/1997 Miotto ..... 297/353
5,725,278 A * 3/1998 Verbeek ..... 297/353
5,791,734 A * 8/1998 Malenotti ..... 297/353
5,853,222 A * 12/1998 Roslund et al. ..... 297/353
5,938,285 A * 8/1999 Verbeek ..... 297/353
6,299,253 B1 * 10/2001 Chen ..... 297/353

* cited by examiner

*Primary Examiner*—Peter M. Cuomo
*Assistant Examiner*—Stephanie Harris
(74) *Attorney, Agent, or Firm*—Joseph H. Golant; Jones Day

(57) ABSTRACT

A simple, inexpensive and reliable chair adjustment mechanism is disclosed. The mechanism includes a base which is fastened to a chair support, a slide attached to an assembly to be adjusted, such as a back or a seat or arms, and a spring device cradled by the base for engaging one of a series of spaced ramps integral with the slide. The slide also includes ramps for pushing the spring device into an out-of-the-way position secured to two hooks on the base so that at the end of the slide's extension it may be returned to a retracted position in one easy movement. When reaching the retracted position, other ramps push the spring device out of the engagement with the hooks so that the spring device extends through a space between the base and the slide to again selectively engage the series of spaced ramps.

17 Claims, 3 Drawing Sheets

CHAIR ADJUSTMENT MECHANISM

CROSS REFERENCE TO RELATED APPLICATION

The present application relates to Provisional Application No. 60/324,295 filed Sep. 25, 2001. This application claims the filing date of the above-identified provisional application as a priority.

BACKGROUND OF THE INVENTION

1. Field of the Invention

The present invention relates to a chair adjustment mechanism and, more particularly, to a mechanism which can conveniently be operated to selectively adjust a seat, back or arm relative to a chair support structure, the mechanism being simple, inexpensive and reliable.

2. Description of Related Art

Many forms of back adjustment mechanisms are known, particularly for chairs used in office environments. Often, it is desirable to adjust the vertical height of a chair back for the comfort of the user as the user is engaged in various office-related tasks. The same is true of a chair seat and a chair arm. One such chair back adjustment mechanism, for example, which is well-known in the art, is a simple slide mechanism which moves vertically on a chair back support, usually comprising one or two tubes, with a manually tightened knob that can lock the back in a predetermined vertical position relative to the chair seat.

While such chair adjustment mechanisms have proved to be reliable and economically manufacturable to produce, it is desirable to provide an improved mechanism which is cost-effective to produce and provides increased convenience to the chair user.

SUMMARY OF THE INVENTION

The difficulties encountered with previous devices have been overcome by the present invention. What is described here is a chair adjustment mechanism comprising a base adapted to be attached to a chair in a fixed position, a slide connected to the base and movable between a retracted position and a fully extended position in relation to the base, the slide being guided by the base, a space formed between the base and the slide, a series of ramps connected to extend between the base and the slide in the space for lockingly positioning the slide in intermediate positions between the retracted position and the fully extended position, a spring device mounted between the base and the slide and capable of engaging the series of ramps, the spring device being flexed between two positions, a first position wherein the spring device makes selective contact with individual ramps of the series of ramps and a second position wherein the spring device is able to avoid engagement with the ramps of the series of ramps, a first high ramp operatively connected to flex the spring device from its first position to its second position, and a second high ramp operatively connected to cause the spring device to move from its second position to its first position.

There are a number of advantages, features and objects achieved with the present invention which are believed not to be available in earlier related devices. For example, one advantage is that the present invention provides a chair adjustment mechanism which is quite simple, being constructed of only three molded synthetic resin parts. Another object of the present invention is to provide a chair adjustment mechanism that is relatively inexpensive. A further advantage of the present invention is to provide a chair adjustment mechanism which is reliable. Another feature of the present invention is to provide a chair adjustment mechanism which may be used to adjust the back of a chair, the seat of a chair or the arms of a chair.

A more complete understanding of the present invention and other objects, advantages and features thereof will be gained from a consideration of the following description of a preferred embodiment read in conjunction with the accompanying drawing provided herein. The preferred embodiment represents an example of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
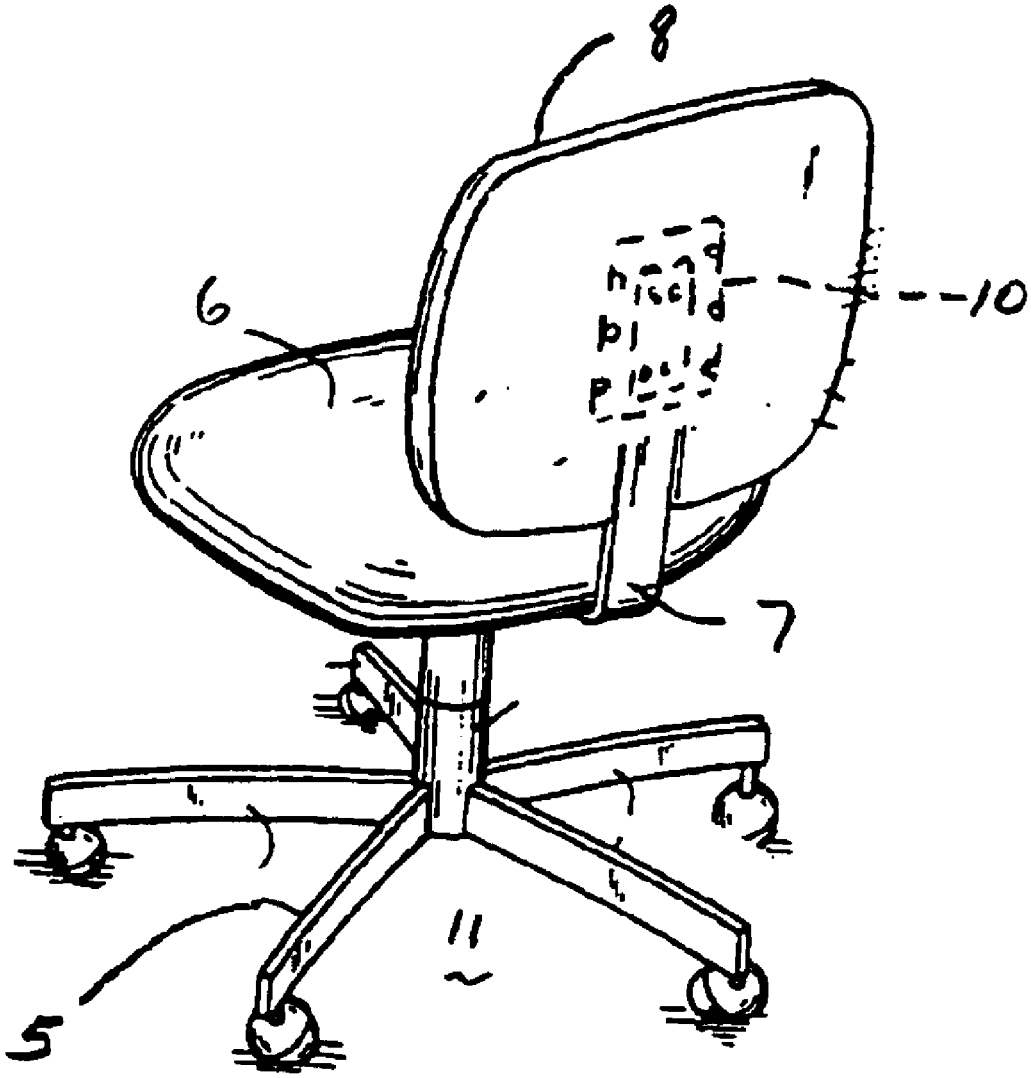
FIG. 1 is a rear isometric view of an office chair showing the chair adjustment mechanism in broken line used as a means for adjusting the height of a chair back relative to a chair seat, for example.

While the present invention is open to various modifications and alternative constructions, the preferred embodiment shown in the various figures of the drawing will be described herein in detail. It is understood, however, that there is no intention to limit the invention to the particular embodiment, form or example disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

An example of an office chair is illustrated in FIG. 1 and includes a chair base 5 upon which is fixed a chair control to which is attached a seat assembly 6, a back support 7 and a back assembly 8. Mounted to the back support and the back assembly is a back height adjustment mechanism 10 (shown in broken line).

Figure 2:
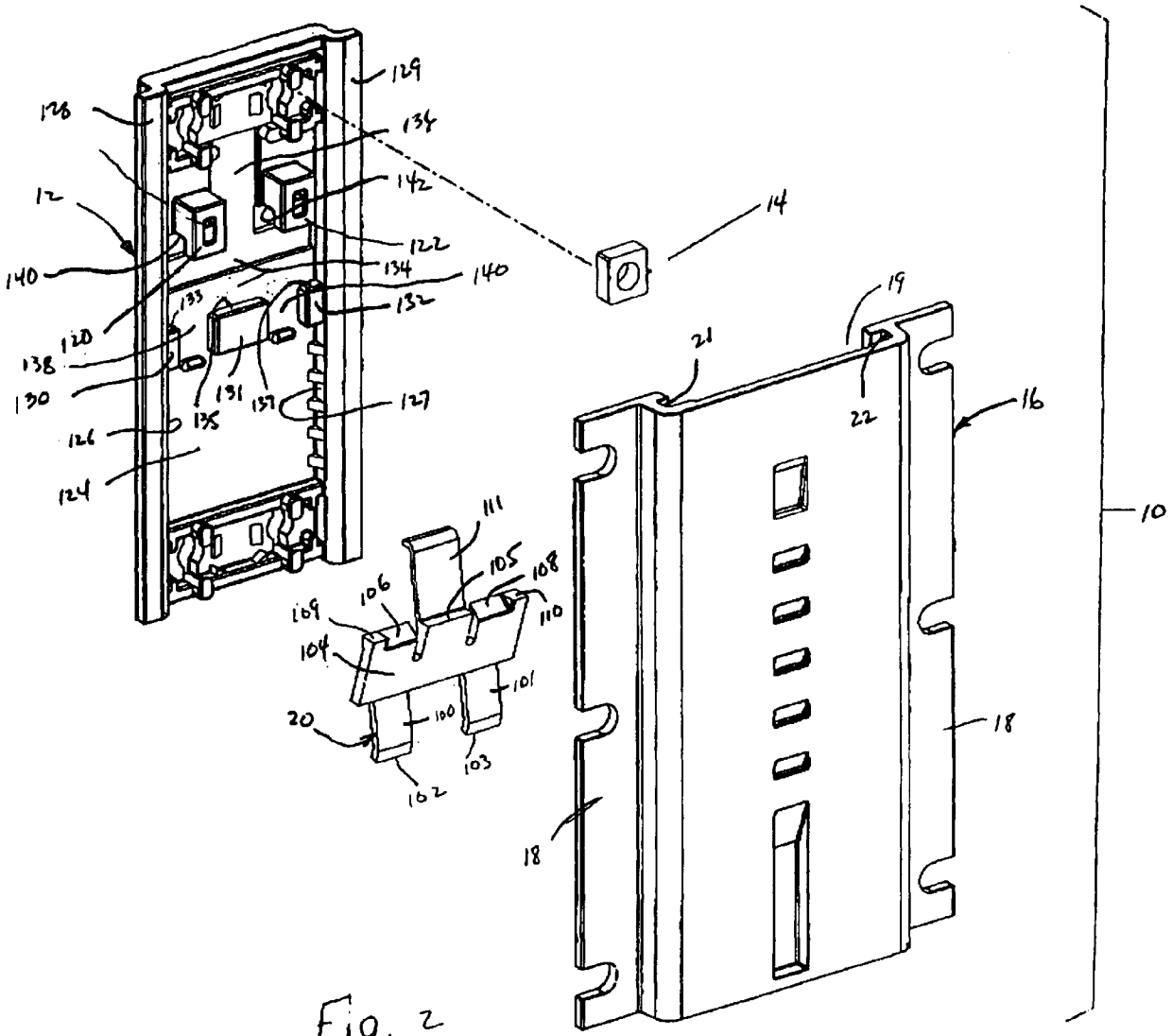
FIG. 2 is an exploded front isometric view of the chair adjustment mechanism.
Figure 3:
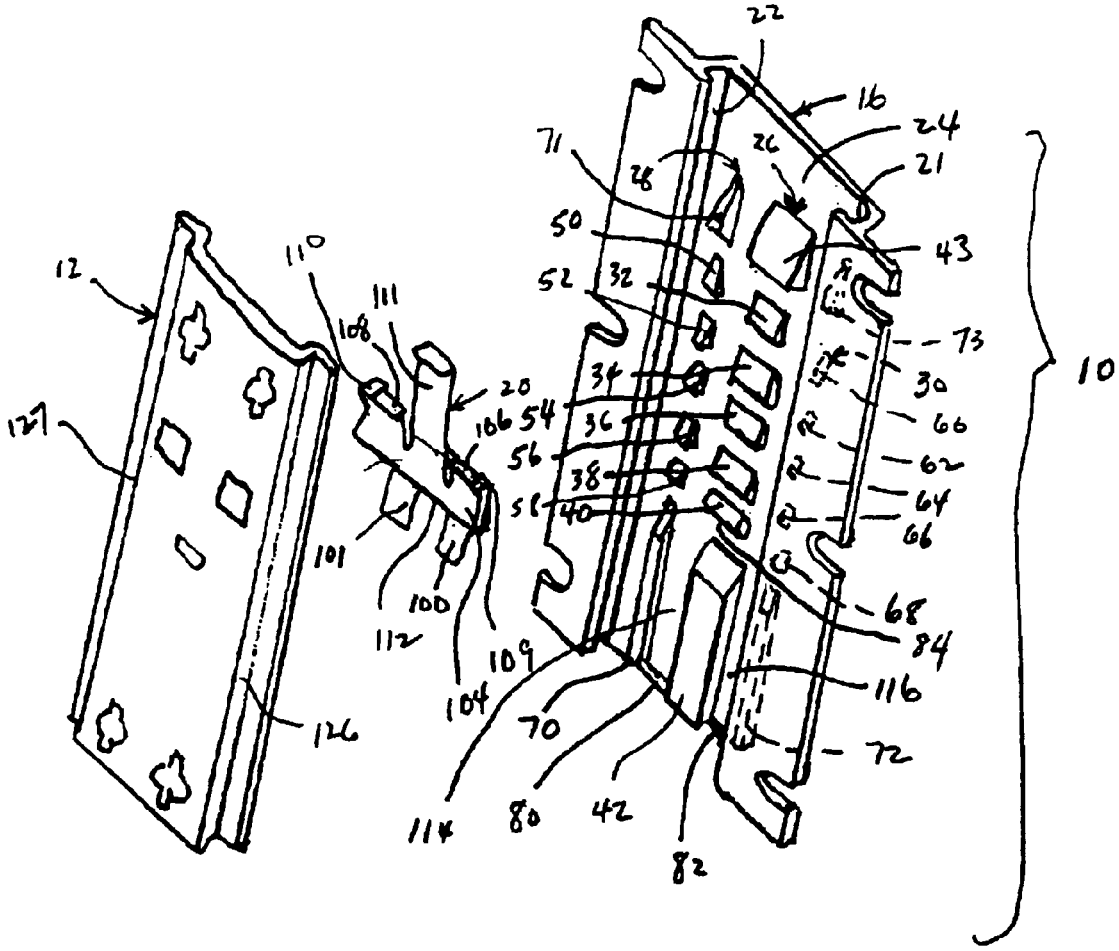
FIG. 3 is an exploded rear isometric view of the chair adjustment mechanism shown in FIG. 2.

Referring now to FIGS. 2 and 3, the back height adjustment mechanism 10 is shown in more detail. The mechanism 10 is simple and includes only three main elements. The first element is an inner guide or base 12 that is provided with openings and suitable nuts 14 such that it can be mounted in a fixed position to a chain support, such as the support 7, FIG. 1. The second element is a slide 16 that mounts to a back board by means of laterally spaced side flanges 18 and fasteners (not shown). The third element is a spring device 20 that is positioned between the base 12 and the slide 16 in a space 19 formed therebetween and allows the slide to selectively lock to the base so as to allow selective adjustment of the height of the chair back relative to chair seat or the floor 11 on which the chair rests. It is understood that the mechanism 10 may also be used as a seat adjustment mechanism and as an arm adjustment mechanism.

The slide 16, in addition to having the side flanges 18, also includes two opposing channel tracks 21, 22 which are engaged by the base 12 as will be explained below. The slide also has a center panel 24 which includes three columns of ramps or cams, a central column 26 of wide ramps and flanking outer columns 28, 30 of narrow ramps. There are a series of five ramps 32, 34, 36, 38, 40 which are used to determine the extended location of the slide 16 in relation to the base 12. In turn this determines the location of a chair back, in relation to a stationary support, such as the support 7. The central column 26 also includes a first high ramp 42 and a second high ramp 43 which both project outwardly from the center panel 24 to a greater distance than the first mentioned five ramps 32, 34, 36, 38, 40. In a like and parallel fashion the two outer rows of ramps 28, 30 each have a series of five smaller ramps, such as ramps 50, 52, 54, 56, 58 in the outer column 28 and the series of ramps 60, 62, 64, 66, 68 in the outer column 30. Parallel to the first high ramp 42 are first outer high ramps such as the high ramp 70 in the outer column 28 and the high ramp 72 in the outer column 30. Parallel to the second high ramp 43 are second high ramps 71, 73 in columns 28, 30, respectively.

Each of the high ramps 70, 71, 72, 73 extend outwardly a greater distance in the space 19 from the center panel 24 than do the earlier mentioned series of ramps in the outer columns. At the end of the slide nearest to the ramps 42, 70, 72 are abutment walls 80, 82. As will be explained below, the various ramps operatively engage the spring device in various ways to cause the spring to selectively abut a center ramp and adjoining side ramps to lock the slide relative to the base. The ramps also act as a cam to the cam follower spring device so that the slide may move about a half an inch to another ramp. When the slide reaches its fully extended position certain ramps cam the spring device away from the series of ramps so that the spring cannot make locking engagement. This allows the slide to return in a single movement to its retracted position. Other ramps act to reengage the spring with the series of ramps to again allow the selective locking of the slide in relation to the stationary base. Each ramp includes an abutment surface, such as the abutment surface 84 of the ramp 40.

The slide may be made of any suitable material such as a synthetic resin and that all of the various parts or portions thereof can be molded at the same time as an integral item.

The spring device 20 includes the two legs 100, 101 with bottom edges 102, 103, a central body 104 with a neck abutment surface 105, two shoulders 106, 108, two shoulder tips 109, 110, a head 111 and an elongated ledge 112. The spring device is also made of a synthetic resin which may be molded as an integral element and is capable of flexing so as to perform one of its various functions. The neck abutment surface 105 selectively engages the series of center ramps 32, 34, 36, 38, 40 of the slide, and the shoulder tips 109, 110 in a like manner engage parallel ramps in the columns 28, 30, so that when engaged the slide is locked relative to the base.

The legs 100, 102 generally move along two longitudinal paths 114, 116 on the center panel 24 of the slide 16. Each path is formed between the center column of ramps 26 and one of the outer columns of ramps 28, 30. However, when the slide is at its fully extended position relative to the base, the high ramps 42, 70, 72 engage the central body 104 of the spring device 20 and cam or wedge the central body shoulders 106, 108 under the hooks 120, 122 against the biasing force provided by a deflection of the head 111 and the bottom edges 102, 103 of the legs 100, 101 are moved to engage the abutment walls 80, 82 at the ends of the longitudinal paths. This prevents further extension of the slide relative to the base.

Once the spring device is engaged by the hooks, the slide can move from the fully extended position all the way to the retracted position without engaging any of the three series of ramps 32, 34, 36, 38, 40, 50, 52, 54, 56, 58, 60, 62, 64, 66, 68. At the retracted position, the shoulder tips 109, 110 engage the uppermost high flanges 71, 73 and the neck abutment surface 105 engages the center ramp 43. The high flanges 71, 73 push the shoulder tips 109, 110, and thereby the spring devices out of engagement with the hooks 120, 122, and the head 111 biases the central body 104 back to a position where the abutment surfaces 105, 109 and 110 again are capable of selectively engaging the three series of ramps.

The base 12 is also made of a single piece of molded synthetic resin and includes a center panel 124, two lateral walls 126, 127, two laterally extending flanges 128, 129, the hooks 120, 122 and abutment blocks 130, 131, 132. The lateral flanges 128, 129 engage the channel tracks 21, 22 of the slide and thereby guide the slide during its movement between a retracted position and a fully extended position, a distance of about two and a half inches in six increments or steps. The base has a space 134 on the center panel 124, adjacent the two hooks 120, 122 for the center body 104 of the spring device 20, a space 136 for the head 111 of the spring device and two parallel spaces 138, 140 for the legs 100, 101 of the spring device. The spaced abutment blocks 130, 131, 132 have abutment surfaces 133,135, 137 to engage the ledge 112 on the rear side of the spring device to allow the spring device to seat or be cradled within the base formed by the lateral walls 126, 127, the center panel 124, the hooks 120, 122 and the abutment surfaces 133, 135, 137 in the spaces 134, 136, 138, 140. The two hook projections 120, 122 have bottom ledges 140, 142. These bottom edges make contact with the shoulders 106, 108.

The slide is about six inches long and four inches wide. The base is about five inches long and about two and a half inches wide. The space 19 is roughly five-sixteenth inches deep, while the spring device is about two inches high and one and three-quarter inches wide. Change in these dimensions are still considered part of the invention.

Operation of the chair adjustment mechanism when used for back height adjustment can now be appreciated with reference to the figures of the drawing. Beginning with the chair back in the down, fully retracked position, the shoulder tips 109, 110 engage the large outer ramps 71, 73 and the neck surface 105 engages the ramp 43. Further, movement disengages the shoulders 106, 108 from the hooks 120, 122. Thereafter the slide may be raised or extended anywhere within the approximately two and a half inches and six steps determined by the positions of the center ramps 32, 34, 36, 38, 40, and corresponding outer ramps, as desired by the chair user. As each center ramp is passed, the center body 104 is flexed relative to the head 111 until the neck surface 105 passes the ramp at which point the center body 104 snaps back into position so that should the slide attempt a reverse movement, the neck surface 105 and the shoulder tips 109, 110 will abut one of the center ramps and corresponding outer ramps and prevent any movement. This locks the back of the chair relative to the seat and may be thought of as the first abutment.

When the last ramp 40 of the five middle ramps is passed further extension of the slide causes the center body 104 to be deflected against the base so that the shoulders 106, 108 engage under the hooks 120, 122 and the leg edges 102, 103 engage the abutment walls 80, 82. This is the second and third abutments. The slide may now be fully retracted in one movement because the spring device is snug against the base and out of the way of the ramps. This condition is maintained until the spring device comes into contact with the uppermost center ramp 43 (in terms of position shown in FIG. 3) and the parallel aligned outer ramps 71, 73. These push the spring device from engagement with the hooks and reset the spring device to allow the slide to be positioned in any one of the six vertical positions mentioned. This is referred to as the fourth abutment.

The above specification describes in detail a preferred embodiment of the present invention. Other examples, embodiments, modifications and variations will, under both the literal claim language and the doctrine of equivalents, come within the scope of the invention defined by the appended claims. For example, making slight modifications to the spring device or to its shape, the shape of the ramps on the slide or the hooks on the base are considered equivalent structures and will also come within the literal language of the claims. Still, other alternatives will also be equivalent as will many new technologies. These are all considered equivalent structures and will also come within the literal language of the claims so other alternatives will also be equivalent as will many new technologies. There is no desire or intention here to limit in any way the application of the doctrine of equivalents nor to limit or restrict the scope of the invention.

What is claimed is:

1. A chair adjustment mechanism comprising:

a base adapted to be attached to a chair, said base having a hook;

a slide connected to said base, said base and said slide being relatively movable between a retracted position and an extended position and said slide having an abutment wall;

a space formed between said base and said slide;

a plurality of structures extending between said base and said slide in said space, each of said plurality of structures having an abutment surface for lockingly positioning said slide relative to said base in intermediate positions between said retracted position and said extended position;

a spring having two legs, a central body and a head mounted in said space, said head for flexing said central body, said central body for engaging selectively said plurality of structures, and said two legs for limiting movement of said slide relative to said base;

a first high structure extending into said space for flexing said central body when said extended position is reached and for causing said central body to slide and become engaged and restrained by said hook, and for causing said legs to engage said abutment wall of said slide and stop movement of said slide relative to said base wherein said central body is not able to engage said plurality of structures; and a second high structure extending into said space for sliding and disengaging said central body from said hook when said retracted position is reached wherein said central body is thereafter able to engage said plurality of structures.

2. The apparatus as claimed in claim 1 wherein:

said plurality of structures is a series of ramps and said series of ramps is connected to said slide.

3. The apparatus as claimed in claim 2 wherein:

said spring device is cradled by said base.

4. The apparatus as claimed in claim 3 wherein:

said first high ramp and said second high ramp are connected to said slide.

5. The apparatus as claimed in claim 2 wherein:

said first high ramp and said second high ramp are connected to said slide; and said spring device includes a first abutment surface for engaging selected ramps.

6. The apparatus as claimed in claim 1 wherein:

said spring includes a first abutment surface for engaging selected structures of said plurality of structures.

7. The apparatus as claimed in claim 1 wherein:

said plurality of structures includes three columns of ramps aligned on said slide;

said first high structure includes a first group of three high ramps positioned at the bottom of said three columns of ramps; and said second high structure includes a second group of three high ramps positioned at the top of said three columns of ramps.

8. The apparatus as claimed in claim 7 wherein:

said abutment wall includes two abutment walls formed at a lower porion of said base; and said hook includes two hooks formed at an upper portion of said base; and a space on said base for mounting the spring adjacent said two hooks.

9. The apparatus as claimed in claim 8 wherein:

said two legs of said spring include abutment surfaces for engaging said two abutment walls;

said central body includes three abutment surfaces for selectively engaging ramps of said ramps in said three columns; and said central body includes two shoulders for engaging said hooks.

10. The apparatus as claimed in claim 9 including:

an abutment block formed on said base; and wherein said central body includes a ledge for engaging said abutment block.

11. The apparatus as claimed in claim 10 wherein:

said three abutment surfaces of said central body are formed on an opposite side of said central body from said ledge.

12. The apparatus as claimed in claim 11 wherein:

said base is an integral molded structure; and said slide is an integral molded structure.

13. A chair adjustment mechanism comprising:

a first structure connected to a chair and having a hook, a ledge and an abutment wall;

a second structure connected to move relative to said first structure between an extended position and a retracted position and having three columns of protrusions including a series of small protrusions, a first group of large protrusions at the top of said columns and a second group of large protrusions at the bottom of said columns; and a third structure having a leg, a central body and a head, said third structure being mounted to slide between said hook and said ledge; and wherein between extended and retracted positions said central body selectively engages said series of small protrusions;

at said extended position, said third structure engages said first group of large protrusions, said leg engages said abutment wall to stop relative movement of said first and second structures and said third structure slides and flexes to engage and be restained by said hook so as to prevent said central body from engaging said series of small protrusions; and at said retracted position, said third structure engages said second group of large protrusions and is disengaged from said hook and said third structure slides to engage said ledge and flexes so as to be able to engage said series of small protrusions.

14. The apparatus as claimed in claim 13 wherein:

said protrusions are ramps.

15. The apparatus as claimed in claim 14 wherein:

said central body of said third structure includes three abutment surfaces for engaging said ramps.

16. The apparatus as claimed in claim 15 wherein:

said central body of third structure includes a ledge for engaging the ledge of said first structure.

17. The apparatus as claimed in claim 16 wherein:

said central body includes a shoulder for engaging said hook.

* * * * *